US005463277A

United States Patent [19]

Kimura et al.

[11] Patent Number: 5,463,277

[45] Date of Patent: Oct. 31, 1995

[54] MICRO VACUUM DEVICE

[75] Inventors: Mitsuteru Kimura, Miyagi; Masato Honma, Yamagata, both of Japan

[73] Assignee: Ricoh Company, Ltd., Tokyo, Japan

[21] Appl. No.: 161,609

[22] Filed: Dec. 6, 1993

[30] Foreign Application Priority Data

| | | | |
|---|---|---|---|
| Dec. 7, 1992 | [JP] | Japan | 4-326383 |
| Nov. 30, 1993 | [JP] | Japan | 5-329952 |

[51] Int. Cl.[6] ..... G09G 3/10

[52] U.S. Cl. ..... 315/169.1; 313/306; 313/310; 313/336

[58] Field of Search ..... 313/306, 309, 313/310, 336; 315/169.1

[56] References Cited

U.S. PATENT DOCUMENTS

| | | | |
|---|---|---|---|
| 4,827,177 | 5/1989 | Le et al. | 313/336 |
| 4,855,636 | 8/1989 | Busta et al. | 313/336 |
| 5,070,282 | 12/1991 | Epsztein | 315/383 |
| 5,145,438 | 9/1992 | Bol | 313/336 |
| 5,148,079 | 9/1992 | Kado et al. | 313/336 |
| 5,204,588 | 4/1993 | Ugajlin | 313/309 |
| 5,300,853 | 4/1994 | Watanabe et al. | 313/336 |

FOREIGN PATENT DOCUMENTS

| | | | |
|---|---|---|---|
| 0444670 | 2/1991 | European Pat. Off. . | |
| 4056040 | 2/1992 | Japan | 313/336 |
| 04286825 | 10/1992 | Japan . | |

OTHER PUBLICATIONS

Journal of Vacuum Sciences & Technology, "Perspectives and Limitations of Vacuum Microtubes", vol. 11, No. 6, (Nov. 1993), pp. 3126–3129.

*Primary Examiner*—Robert J. Pascal
*Assistant Examiner*—Darius Gambino
*Attorney, Agent, or Firm*—Lowe, Price, LeBlanc & Becker

[57] ABSTRACT

In the micro vacuum device according to the present invention, an electron emitter is formed into a thin film form on a thin film heater rising in midair by means of air bridge, or a thin film heater is formed as an electron emitter, and the electron emitter is provided adjacent to a gate with a space therebetween so that field emission of electrons is easily effected, or the electron emitter is heated so that thermoelectrons are easily emitted.

37 Claims, 13 Drawing Sheets

MICRO VACUUM DEVICE

FIELD OF THE INVENTION

The present invention relates to a micro vacuum device having an electron or a thermoelectron field emission type of electron emitter, and more particularly to a micro vacuum device which can be applied to a micro triode vacuum device or a micro vacuum magnetism sensor.

BACKGROUND OF THE INVENTION

Generally a conventional type of micro vacuum device has an electron emitter, a gate, and a collector each formed in a vacuum on a silicon substrate by making use of the semiconductor micromachining technology with the gate provided adjacent to the electron emitter having a needle-like or a thin film form.

However, in the conventional type of micro vacuum device, as a degree of vacuum becomes lower, the field emission of electron characteristics is degraded due to such causes as absorption of gas into a surface of an electron emitter.

SUMMARY OF THE INVENTION

It is a first object of the present invention to improve the electron discharge characteristics even in a relatively low degree of vacuum fur enabling reduction of required supply voltage by activating a surface of an electron emitter by heating the surface of the electron emitter to cause it to emit such materials as a gas absorbed therein so that field emission of electrons is easily effected or by heating the electron emitter so that field emission of electron are easily emitted.

Also it is a second object of the present invention to enable mass production of electron emitters each having a fine and high precision bridged thin film heater which can be formed by using the semiconductor micromachining technology.

In order to achieve the above objects as described above, in the present invention, a micro vacuum device having an electron emitter, a gate and a collector is placed in a vacuum, the electron emitter described above is formed in a thin film form on a bridged thin film heater, and the foregoing electron emitter is provided adjacent to the gate with a space therebetween so that the electron emitter can cause field emission of electrons.

Also in the present invention, the thin film heater is formed as the electron emitter, an electric current flowing between the electron emitter and the electron collector is changed by changing the voltage loaded to the gate, the electron emitter provided adjacent to the gate has a very sharp tip section, the electron emitter provided adjacent to the gate has a plurality of tip section to the same thin film heater, and a slit is provided in a section facing a tip section of the electron emitter.

Also in the present invention, a plurality of the collectors are provided in adjacent to each other, a strength as well as a direction of an external magnetic field is detected by detecting a strength of a current flowing in the plurality of collectors, the collector described above is formed into a thin film form, and the collector comprises a plurality of layers with an insulating thin film provided between each layer. Also a convex section is provided on the surface of the electron emitter.

Furthermore in the present invention, using a silicon single crystal chip with a concave section formed on the surface as a cover, the region including the concave section is sealed in a vacuum to form a micro vacuum region chamber,and electrodes of the electron emitter, the gate and the collector are extended via the insulating thin film to outside of the micro vacuum region.

Also in the present invention, a micro vacuum device having an electron emitter, a gate, and a collector is placed in a vacuum, the collector is formed with a conductive substrate, a gate electrode is provided via an insulating thin film on the collector, a hole is formed on the insulating thin film so that the collected is exposed to inside of the gate electrode, an electron emitter formed into a thin film form on a thin film heater is provided at a center of the hole, and the electron emitter is adjacent to the gate so that the electron emitter causes field emission of electrons.

Also in the present invention, the thin film heater is formed as an electron emitter as described above, an electric current flowing between the electron emitter and the collector is changed by changing a voltage loaded to the gate, the electron emitter provided near a center of the hole has a sharp tip section, the electron emitter provided near the center of the hole has a plurality of tip sections each facing the same thin film heater, and a slit is provided in a section facing the tip section formed on the electron emitter.

Also a convex section is provided on the surface of the electron emitter.

Furthermore in the present invention, using a silicon single crystal chip with a concave section formed on the surface as a cover, a region including the concave section is sealed in a vacuum to form a micro vacuum region chamber, and electrodes of the electron emitter, the gate and the collector are extended via an insulating thin film to outside f the micro vacuum region.

In the micro vacuum device according to the present invention, an electron emitter is formed into a thin film form on a thin film heater rising in midair by means of air bridge, or a thin film heater is formed as an electron emitter, and the electron emitter is provided adjacent to a gate with a space therebetween so that field emission of electrons is easily effected, or the electron emitter is heated so that thermo-electrons are easily emitted.

Also in the present invention, an electric current flowing between an electron emitter and a collector is changed by changing a voltage loaded to a gate. Also the electron emitter provided adjacent to the gate has a sharp tip section to concentrate an electric field so that the electron emission efficiency is improved.

Also a plurality of tip sections each facing the same thin film heater are provided in the electron emitter provided adjacent to the gate so that a larger current flows in the tip section. Also in the present invention, a slit is provided in a section facing the tip section formed in an electron emitter, so that electrical resistance and a heat capacity in the thin film heater are reduced and a higher temperature as compared to that in other portions can be maintained in the thin film heater section, which contributes to reduction of power consumption. Also in the present invention, a plurality of collectors each having a thin film form are provided in a multilayered form with an insulating thin film provided between each collector, and a strength as well as direction of an external magnetic field is detected by detecting a strength of an electric current flowing in the plurality of collectors.

Also in the present invention, a convex section is provided on a surface of an electron emitter, so that the mechanical strength increases.

Furthermore in the present invention, using a silicon single crystal with a concave section of the surface as a cover, a region including the concave section is sealed in a vacuum to form a micro vacuum region, and electrodes of the electron emitter, gate and collector are extended via an insulating thin film to outside of the micro vacuum region, so that mass production of fine and high precision micro vacuum devices is enabled by using the semiconductor micromachining technology.

Also in the micro vacuum device according to the present invention, a collector is formed with a collector, a gate electrode is provided via an insulating thin film on the collector, or a thin film heater is formed as an electron emitter, a hole is formed on the insulating thin film so that the collector is exposed to inside of the gate electrode, the electron emitter formed into a thin film form on the thin film heater is provided adjacent to a center of the hole, and the electron emitter is provided adjacent to the gate to the electron emitter can easily cause field emission of electrons, or the electron emitter is heated so that thermoelectrons are easily emitted.

Also in the present invention, an electric current flowing between the electron emitter and the collector is changed by changing a voltage loaded to the gate. Also the electron emitter provided adjacent to a center of the hole has a sharp tip section so that an electric field is concentrated and the electron emission efficiency is improved. Also the electron emitter provided adjacent to a center of the hole has a plurality of tip sections each facing the same thin film heater, so that a larger current flows in the section as compared to that flowing in other portions thereof.

Also in the present invention, a slit is provided in a section facing the tip section formed in the electron emitter, so that electrical resistance and a heat capacity in the thin film heater are reduced and a higher temperature as compared to that in other portions can be maintained, which contributes reduction of power consumption.

Also in the present invention, a convex section is provided on a surface of the electron emitter, so that the mechanical strength increases.

Also in the present invention, using a silicon single chip with a concave section formed on the surface as a cover, a region including the concave section is sealed in a vacuum to form a micro vacuum region chamber, and electrodes of the electron emitter, gate and collector are extended via an insulating thin film to outside of the micro vacuum region, so that mass production of fine and high precision micro vacuum device using the semiconductor micromachining technology is enabled.

As described above, in the micro vacuum device according to the present invention, it is possible to improve the electron emission characteristics even in a vacuum having a relatively low degree of vacuum and reduce a supply voltage to a relatively small one by heating a surface of the electron emitter so that such materials as absorbed gases will be emitted from the surface and activated for more easily using field emission of electrons or by heating the electron emitter for causing field emission of thermoelectrons in a state where thermoelectrons are easily emitted.

Also the present invention enables production of micro vacuum device by using the semiconductor micromachining technology so that vacuum devices each having a fine and high precision bridged thin film heater can easily be produced in mass.

Other objects and features of this invention will become understood from the following description with reference to the accompanying drawings.

DESCRIPTION OF THE PREFERRED EMBODIMENTS

Description is made hereinafter for an embodiment of a micro vacuum device according to the present invention with reference to the related drawings.

Figure 1:
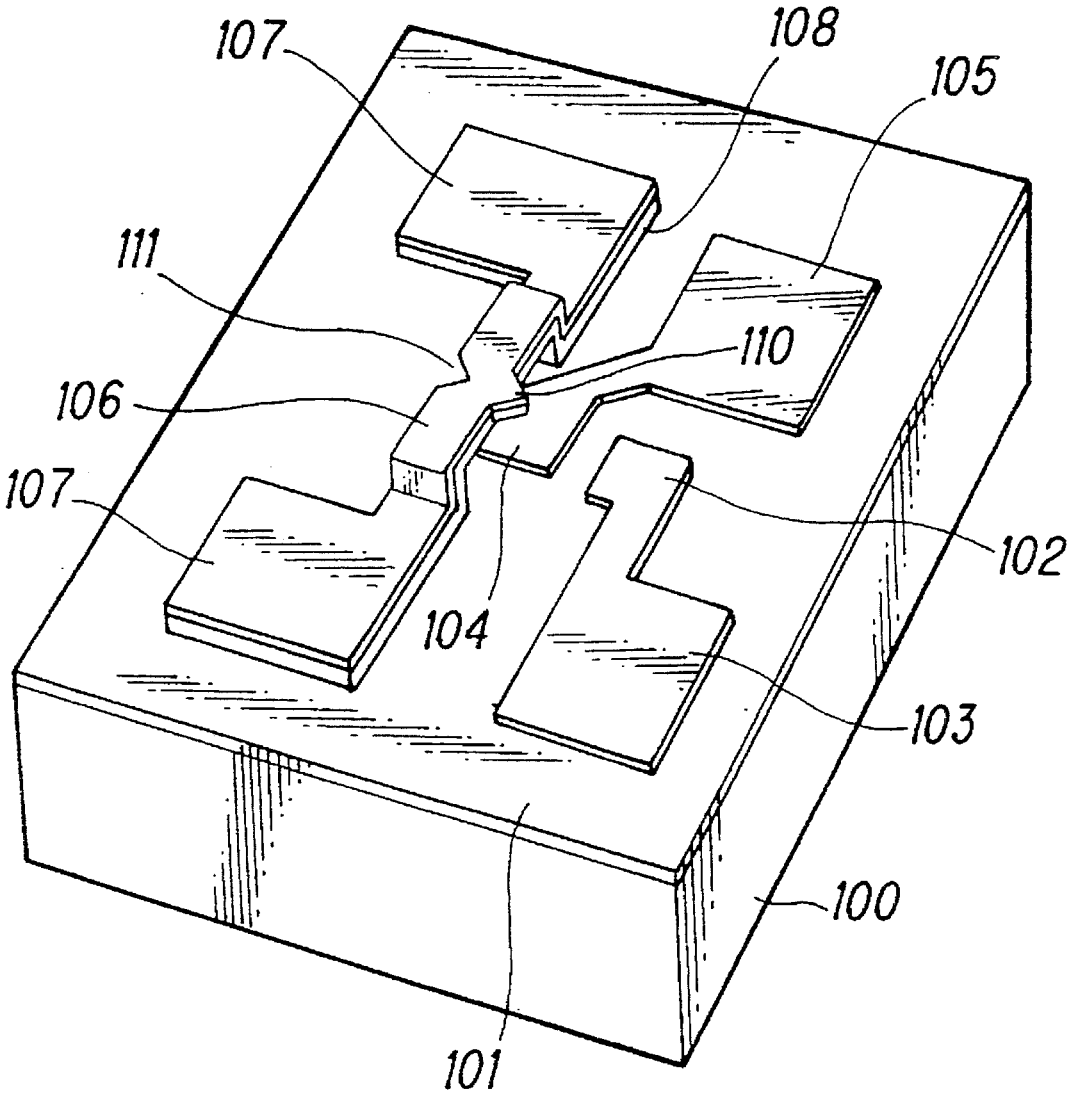
FIG. 1 is a perspective view illustrating configuration of a micro vacuum device according to the present invention.
Figure 2A:
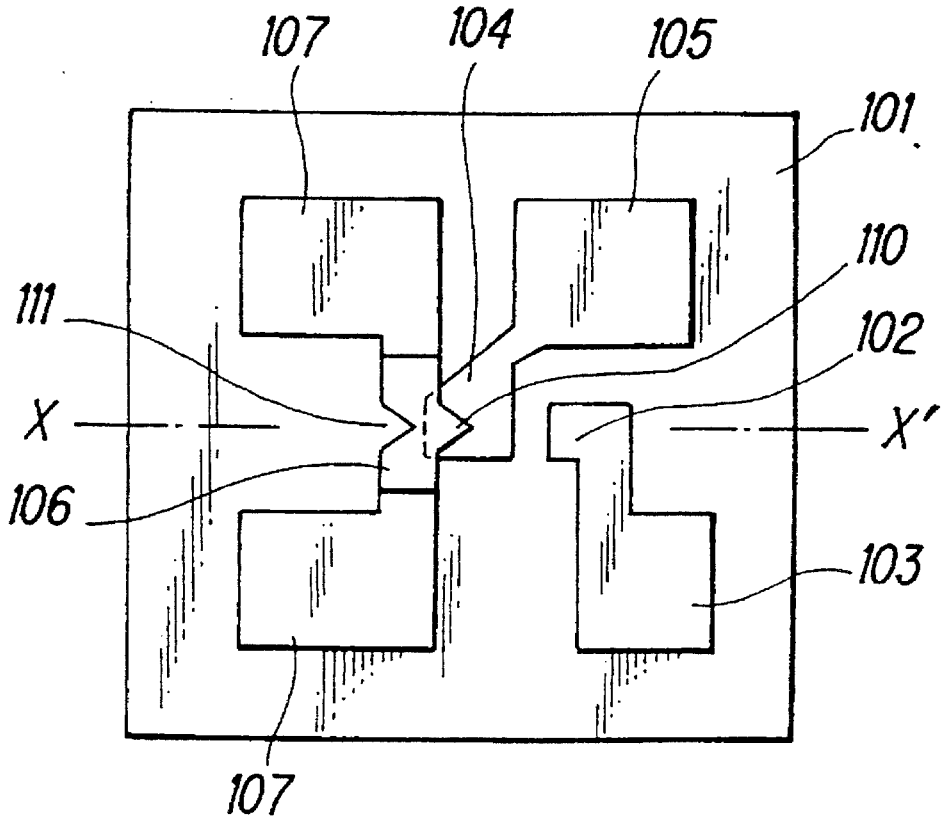
FIG. 2A is a flat view of the micro vacuum device shown in FIG. 1.
Figure 2B:
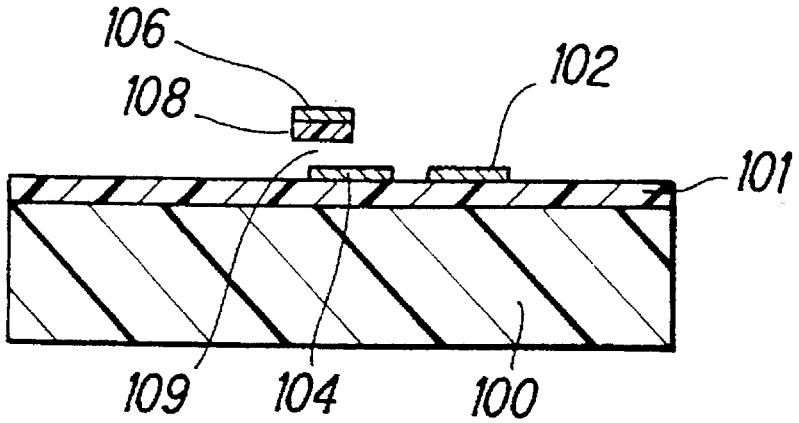
FIG. 2B is a cross sectional view of the micro vacuum device shown in FIG. 1.

In the drawings, FIG. 1 is a perspective view illustrating an embodiment of a micro vacuum device according to the present invention, FIG. 2A is a flat view of the micro vacuum device shown in FIG. 1, and FIG. 2B is a cross sectional view of the micro vacuum device shown in FIG. 2A taken along the line X—X' in the figure.

In FIG. 1, FIG. 2A and FIG. 2B, designated at the reference numeral 100 is an N-type silicon substrate, at 101 a silicon oxide film formed on the N-type silicon substrate, at 102 a collector, at 103 a collector electrode which is an electrode for the collector 102, at 104 a gate, at 105 a gate electrode which is an electrode for the gate 104, at 106 a thin film heater/electron emitter, at 107 a thin film heater/electron emitter electrode which is an electrode for the thin film heater/electron emitter 106, at 108 a silicon oxide film provided between the thin film heater/electron emitter 106 as well as the thin film heater/electron emitter 107 and the silicon oxide film 101, at 109 a space formed between the gate 104 and the thin film heater/electron emitter 106, at 110 a sharpened tip section formed in a section of the thin film heater/electron emitter 106, and at 111 a slit provided in the base potion of said tip section.

Figure 3:
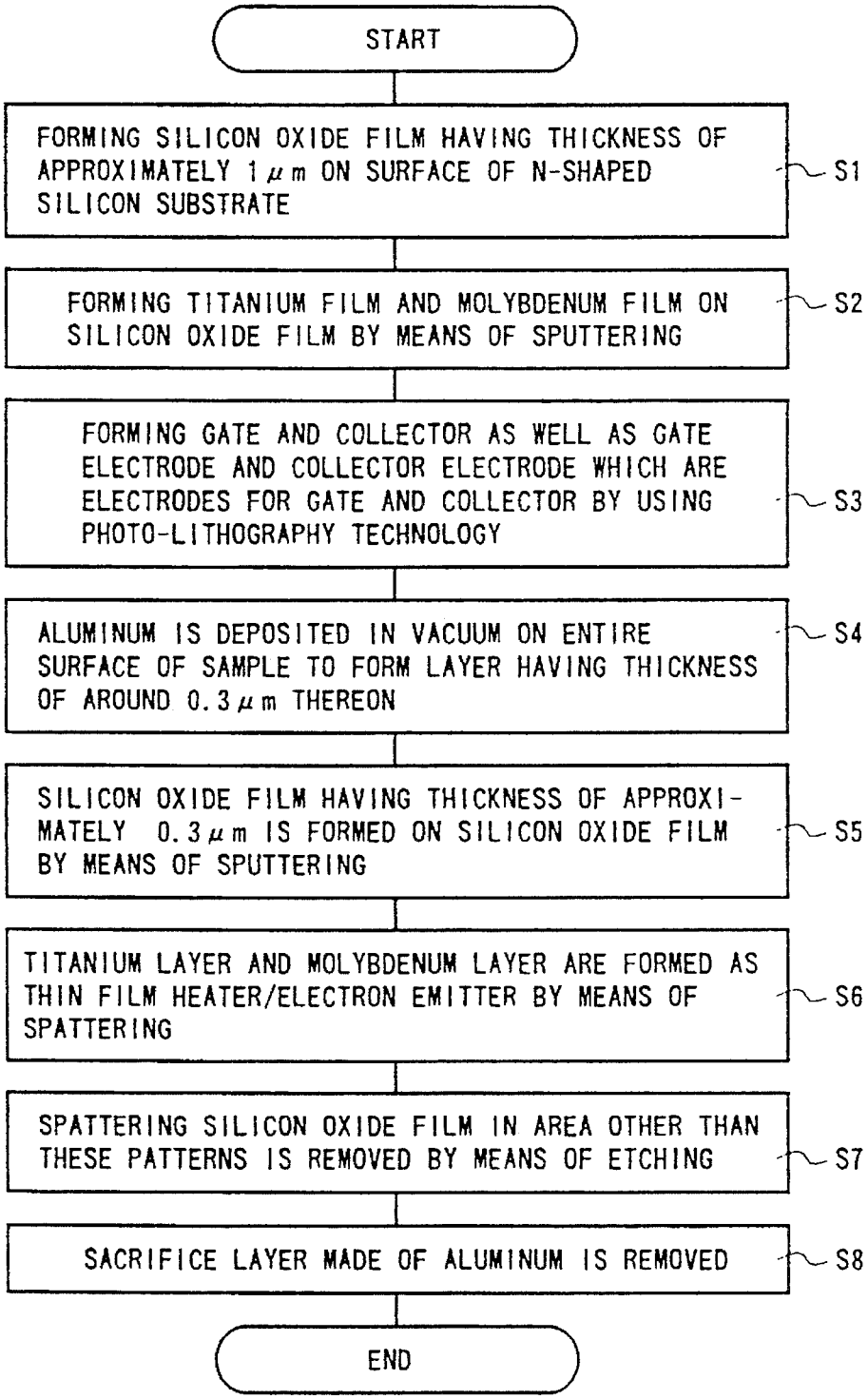
FIG. 3 is a flow chart illustrating a production process of the micro vacuum device shown in FIG. 1.

Next description is made for a method of producing the micro vacuum device as described above with reference to the flow chart shown in FIG. 3. The micro vacuum device according to this embodiment is a case where a bridged thin film heater is formed and the thin film heater itself is used as an electron emitter (thin film heater/electron emitter electrode 106), and this micro vacuum device is produced by at first forming the silicon oxide film having a thickness of approximately 1 μm on a surface of an N-shaped silicon substrate (S1), then forming a titanium film (having a thickness of 0.05 μm) and a molybdenum film (having a thickness of 0.2 μm) on the silicon oxide film 101 by means of sputtering (S2), and forming the gate 104 and the collector 102 as well as the gate electrode 105 and the collector electrode 103 which are electrodes for the gate 104 and the collector 102 by using the photolithography technology (S3). It should be noted that the thin titanium layer is sandwiched between the molybdenum layer and the silicon oxide layer as described above to improve the adherence of the molybdenum layer. The space between the gate 104 and the collector 102 is in a range from 5 to 8 μm, and the length between the gate 104 and the collector 102 along the line X—X' in the flat view shown in FIG. 2A is around 10 μm.

Then aluminum is deposited in a vacuum on the entire surface of a sample to form a layer having a thickness of around 0.3 μm thereon (S4), which is used as a sacrifice layer to form the bridged thin film heater/electron emitter 106. To carry out this operation, aluminum of the sacrifice layer in portions of the sacrifice layer other than an section where the thin film heater/electron emitter 106 rising in midair is formed is removed by means of etching, leaving aluminum in said section having a width wider than the thin film/electron emitter 106. Then the silicon oxide film 108 having a thickness of approximately 0.3 μm is formed on the silicon oxide film 101 by means of sputtering (S5), and furthermore a titanium layer (with a thickness of 0.05 μm) and a molybdenum layer (with a thickness of 0.5 μm) are formed as the thin film heater/electron emitter 106 by means of spattering (S6).

Then the bridged thin film heater/electron emitter 106 having a length of 30 μm and a width of 15 μm and the bridged thin film heater/electron emitter electrode 107 which is an electrode for the thin film heater/electron emitter 106 are formed by patterning, and furthermore the spattering silicon oxide film 108 in an area other than these patterns is removed by means of etching (S7), and finally the sacrifice layer made of aluminum is removed (S8). A space between a tip section of the thin film heater/electron emitter 106 and the collector 102 is around 10 μm. An etching rate in the aluminum layer is high to a hydrogen fluoride-based etchant for the silicon oxide film 108, so that most of the sacrifice layer made of aluminum is also removed, and the portion of the bridged thin film heater/electron emitter 106 and having an extremely narrow space 109 which is almost the same as a thickness of the aluminum sacrifice layer is formed between the thin film heater/electron emitter 106 and the gate 104.

If much aluminum remains in the sacrifice layer, the aluminum sacrifice layer can be removed by using a phosphoric acid-based aluminum etchant. This phosphoric acid-based aluminum etchant does not etch a silicon oxide film, so that the spatter silicon oxide film 108 adhering to the thin film heater/electron emitter 106 and the silicon oxide film 101 beneath the spatter silicon oxide film 108 remain. It should be noted that, as a molybdenum thin film is not affected by a phosphorous acid-based silicon oxide film etchant, the thin film heater/electron emitter 106, the gate 104, the collector 102, and electrodes 103, 105, and 107 for these components remain without being affected by the etchant.

Also in the present embodiment, as shown in FIG. 1 and FIG. 2A, the sharpened tip section to concentrate an electric field on the thin film heater/electron emitter 106 is provided in the side of the collector 102. Concentration of an electric field becomes easier by sharpening the tip section 110 of the thin film heater/electron emitter 106, and a state where field emission of electrons is easily effected is realized.

Also the slit 111 is provided in a base potion corresponding to the tip section 110 of the thin film heater/electron emitter 106 having an air bridge construction. By providing the slit 111 as described above, electrical resistance and a heat capacity in this portion of the thin film heater are reduced and a temperature in this section becomes higher as compared to that in other portions, which makes it possible to reduce power consumption in the device. As a vacuum area in a micro vacuum device is small, a large power is required, and as a result, a wall of the vacuum chamber is heated, which in turn causes emission of unnecessary out gas from the wall and decrease of a degree of vacuum in the vacuum chamber, said states not desirable in a vacuum device. To solve this problem, in this embodiment, the slit 111 is provided as described above, and a vacuum region in a vacuum chamber is enlarged so that the vacuum device can work with smaller power.

Figure 4:
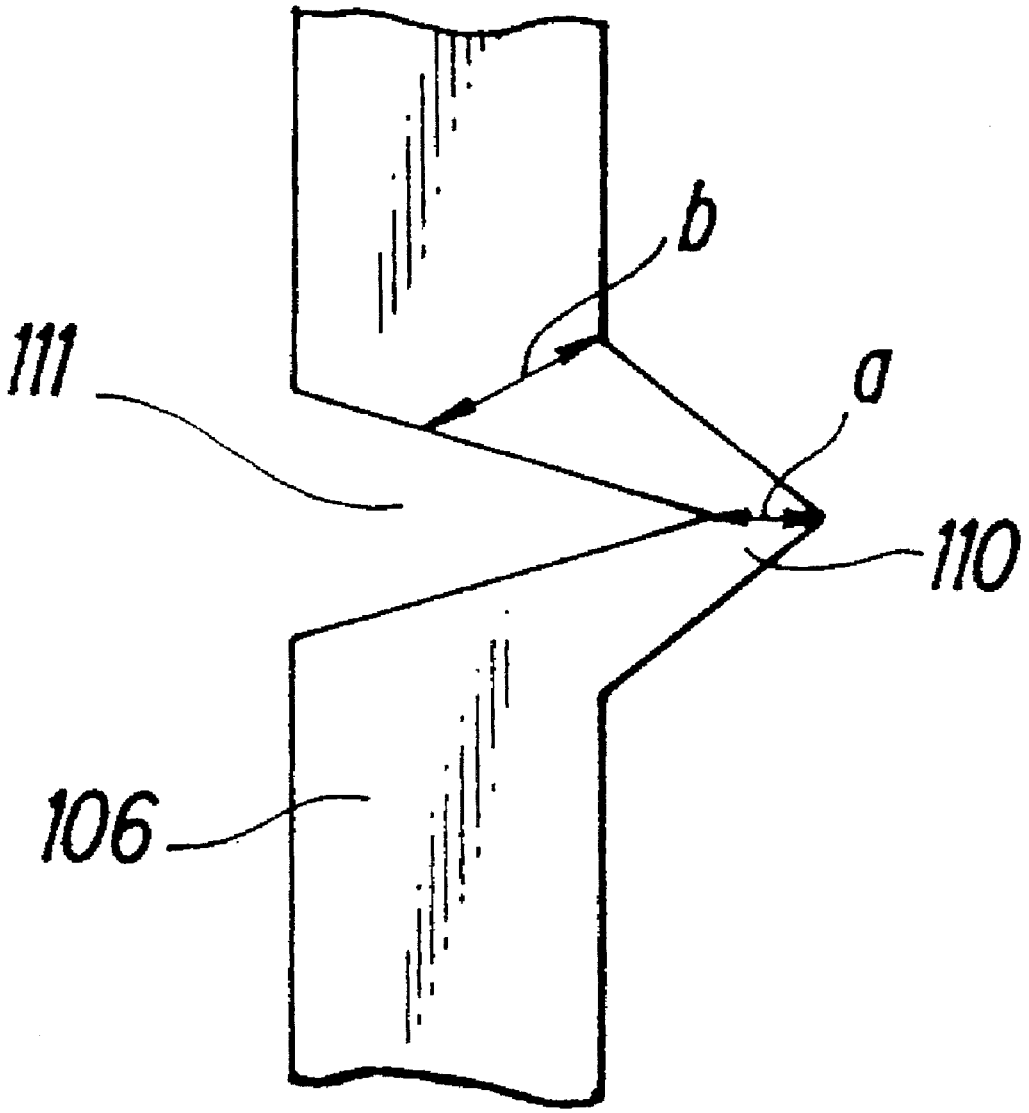
FIG. 4 is a view illustrating another form of the thin film heater/electron emitter shown in FIG. 1.

FIG. 4 is a drawing illustrating a different construction of a tip section of the thin film heater/electron emitter 108, and in this embodiment a width a of the front portion of the tip section is narrow while a width b of the base portion of the tip section is large (a<b), so that the heating value at the tip section 110 is especially large. This section may comprise a molybdenum/titanium or platinum titanium dual layer. Also as a metallic layer extends and hangs down when a temperature goes up, it is preferable to provide an electrically insulating material having a high melting point such as a silicon oxide film beneath the metallic thin film heater to support the latter.

Figure 5A:
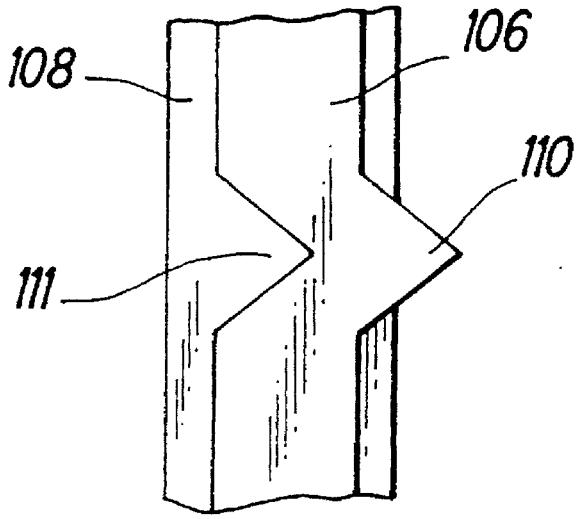
FIG. 5A is a flat view illustrating a different form of the thin film heater/electron emitter shown in FIG. 1.
Figure 5B:
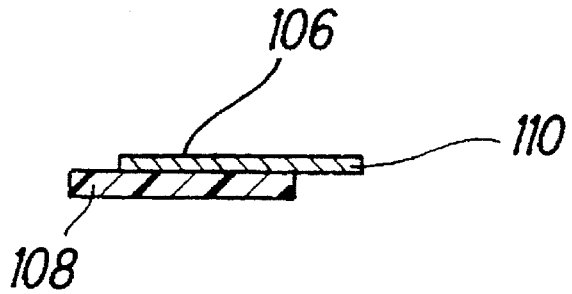
FIG. 5B is a cross sectional view illustrating the different form of the thin film heater/electron emitter shown in FIG. 1.

FIG. 5A and FIG. 5B are views each illustrating a different construction of the tip section of the thin film heater/electron emitter 106, and in this embodiment the silicon oxide film beneath the tip section 110 is removed. When constructed as described above, there is no silicon oxide film adhering to the tip section 110 of the thin film heater/electron emitter 106, so that a temperature easily rises in this portion and power consumption in the thin film heater can be reduced.

Figure 6:
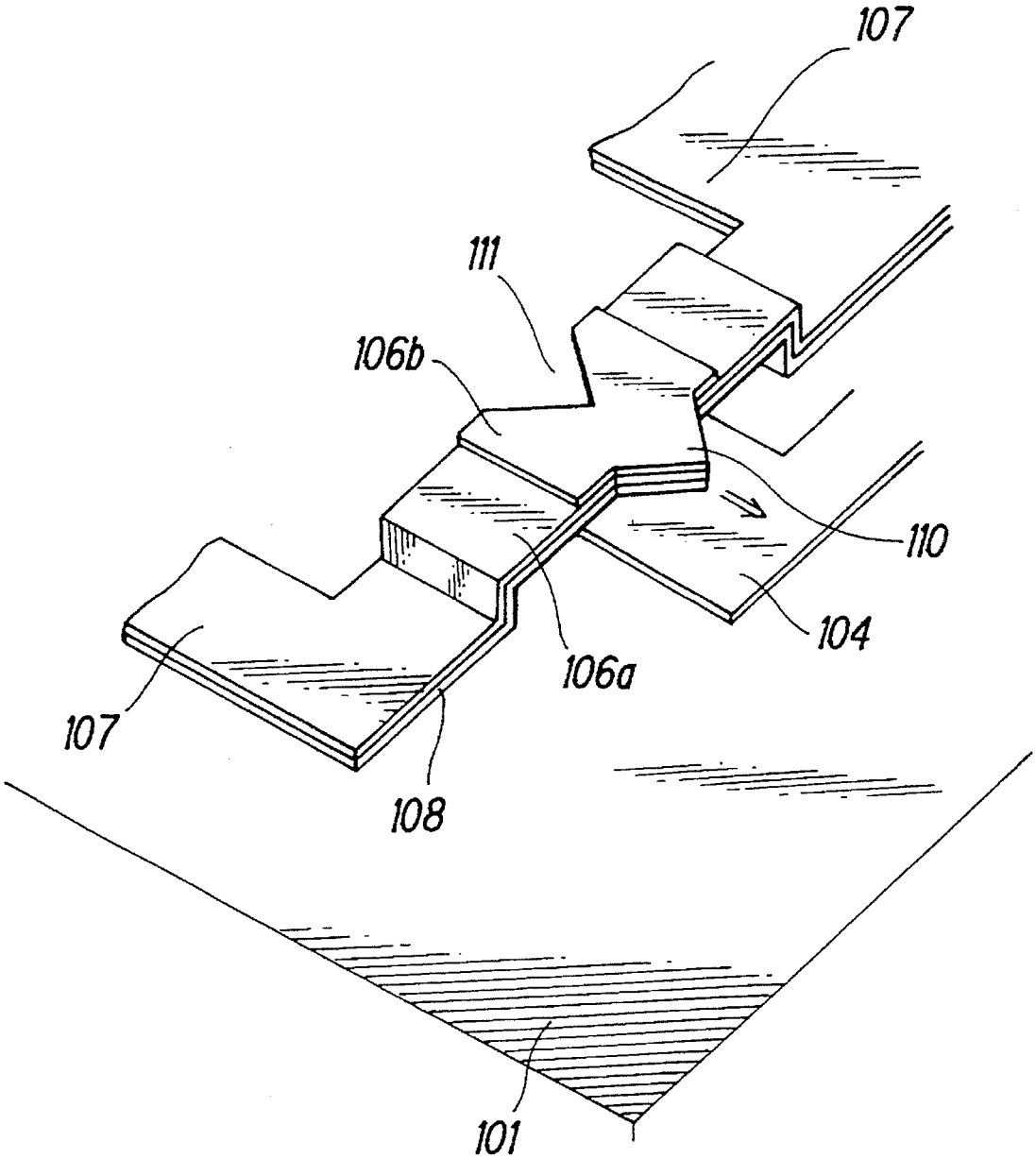
FIG. 6 is a view illustrating a different form of the thin film/electron emitter shown in FIG. 1.

FIG. 6 is a perspective view illustrating a construction of a portion of an electron emitter, and in this figure, designated at the reference numeral 106*a* is a thin film heater, and at 106*b* an electron emitter. In the embodiment described above, a thin film heater and an electron emitter are monolithically integrated as the thin film heater/electron emitter 106, but in the embodiment shown in FIG. 6, the electron emitter 106*b* is formed on the thin film heater 106*a*. Also in this embodiment, a sputter film made of barium oxide or thorium oxide having a small work function is used as the electron emitter 106*b*. In the configuration described above, if the electron emitter 106*b* made of, for instance, barium oxide is heated by the thin film heater 106*a* comprising a platinum/titanium dual layer, field emission of electrons is effected from the electron emitter 106*b* in the direction by an arrow head in the figure when a positive voltage is loaded to the collector 102, as a work function of the electron emitter 106*b* is smaller.

Figure 7:
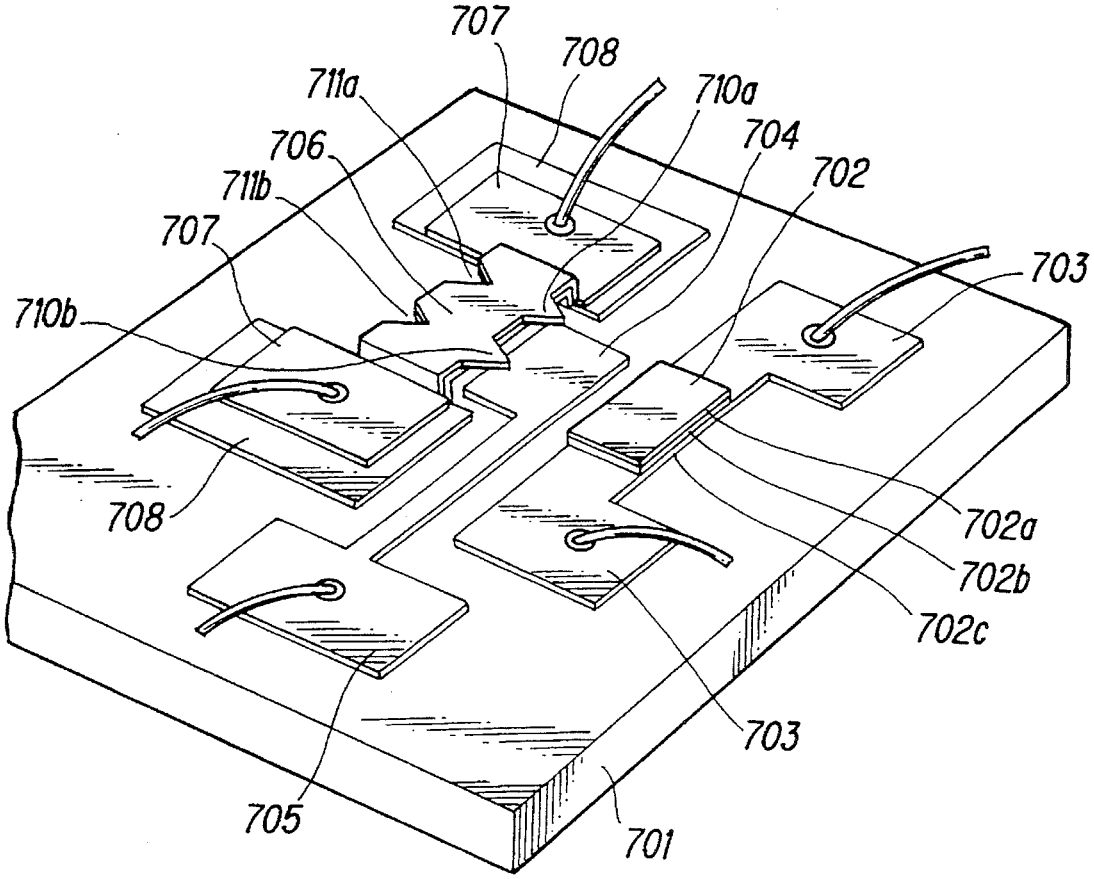
FIG. 7 is a perspective view illustrating another configuration of the micro vacuum device according to the present invention.
Figure 8A:
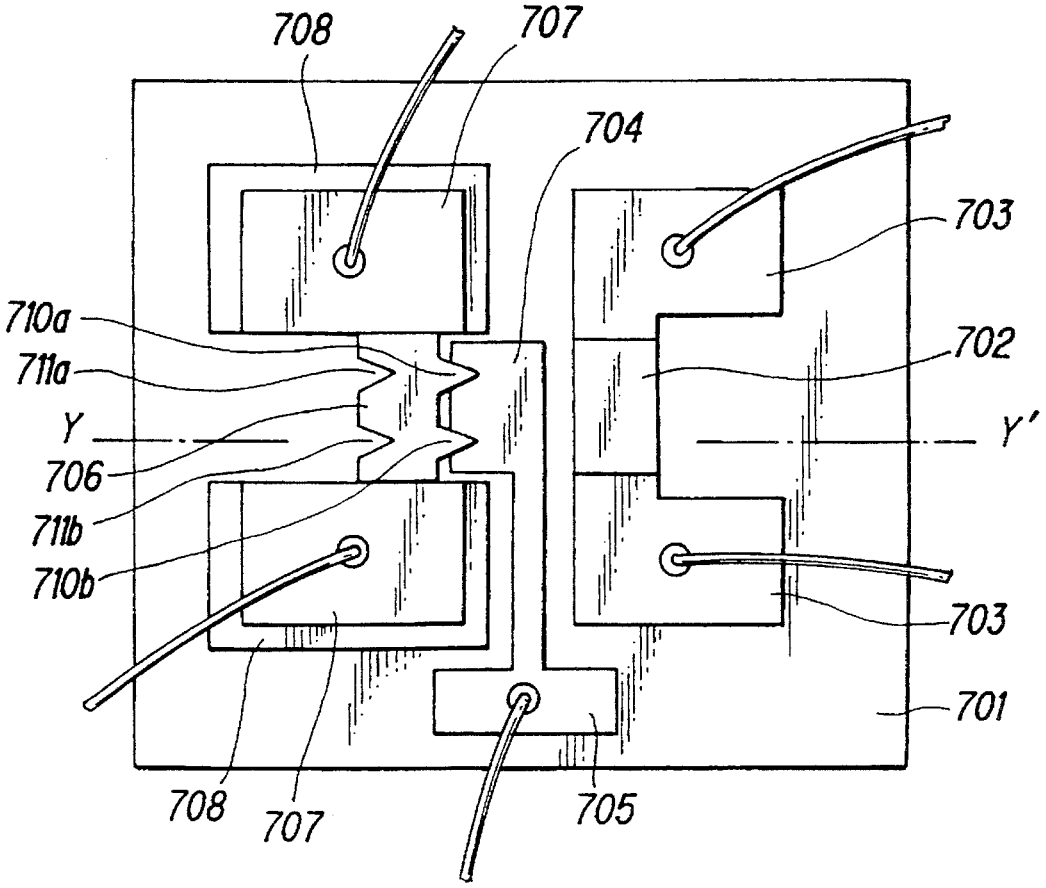
FIG. 8A is a flat view of the micro vacuum device shown in FIG. 7.
Figure 8B:
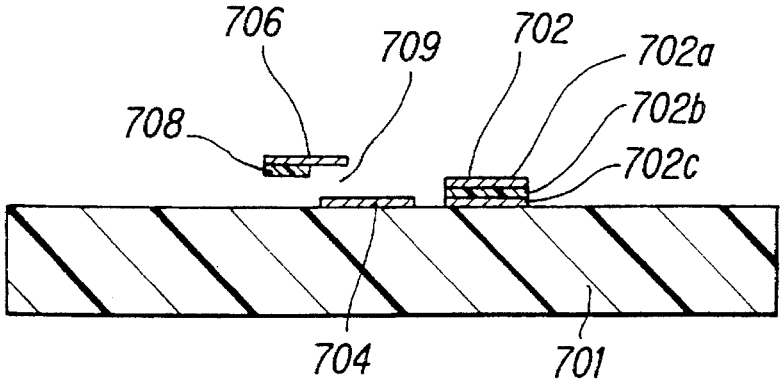
FIG. 8B is a cross sectional view of the micro vacuum device shown in FIG. 7.

FIG. 7 is a perspective view illustrating another embodiment of the micro vacuum device according to the present invention,FIG. 8A is a flat view of the micro vacuum device shown in FIG. 7, and FIG. 8B is a cross sectional view of the micro vacuum device shown in FIG. 8A taken along the line X—X' in the figure.

In FIG. 7, FIG. 8A and FIG. 8B, designated at the reference numeral 710 is a substrate made of quarts, at 702 a collector, at 703 a collector electrode which is an electrode of the collector 702, at 704 a gate, at 705 a gate electrode which is an electrode of the gate 704, at 706 a thin film heater/electron emitter, at 707 a thin film heater/electron emitter electrode which is an electrode of the thin film heater/electron emitter 706, at 708 a molybdenum/titanium film provided between the thin film heater/electron emitter 707 and the substrate 701, at 709 a space formed between the gate 704 and the thin film heater/electron emitter 706, at 710*a* and b sharpened tip sections each formed in a portion of the thin film heater/electron emitter 706, and at 711*a* and b slits each facing to each of the tip sections 710 a and b provided in the base portion of each of the tip sections 710*a* and b.

Next description is made for the molybdenum/titanium film 708 provided between the thin film heater/electron emitter 707 and the substrate 701. As shown in the figures, a portion of electrode of the thin film heater/electron emitter 706 comprises a dual construction (consisting of the thin film heater/electron emitter 707 and the molybdenum/titanium film 708), said molybdenum/titanium film 708 has a construction in which a molybdenum thin film is overlaid on a titanium thin film layer, and this titanium improves adherence of the electrode portion to the substrate 701. Also the thin film heater/electron emitter 707 on the molybdenum/titanium film 708 is made of, for instance, platinum/titanium or indium tin oxide (ITO). In this case, the molybdenum/titanium film 708 is used as a material of the gate electrode 705 and the collector electrode 703 in a process of producing a micro vacuum device.

Next description is made for configuration of the collector 702. The collector 702 has a layered construction comprising a first collector 702*a* and a second collector 702*c* with an electrically insulating thin film layer 702*b* provided therebetween. In this configuration, an electron beam emitted from the thin film heater/electron emitter 706 is collected more by one in the pair of collectors 702*a* and 702*c* due to a Lorentz force in a magnetic field to be detected, and the magnetic field can be detected by detecting a change of an electric current flowing in the collectors 702*a* and 702*c*.

More detailed description is made for configuration of the collector 702. In a micro vacuum device, if the collector 702 is formed as a dual layer body with an electrically insulating layer 702 b having a thickness of around 0.2 μm such as a silicon oxide film sandwiched therein by means of sputtering or CVD(chemical vapor deposition) and caused to emit electron, the micro vacuum device can be used as a high sensitivity magnetism sensor. As an magnetic field component, which is vertical to an electron beam emitted to the two collectors 702*a* and 702*c* and at the same time parallel to the collectors 702*a* and 702*c* is deflected due to a Lorents force and the electron beam is collected more by either one of the two collectors, so that a strength and a direction of the magnetic field can be detected by comparing the currents flowing in the two collectors 702*a* and 702*b*. As a result, a micro magnetism sensor with a high sensitivity and a fast response speed can be obtained.

Figure 9:
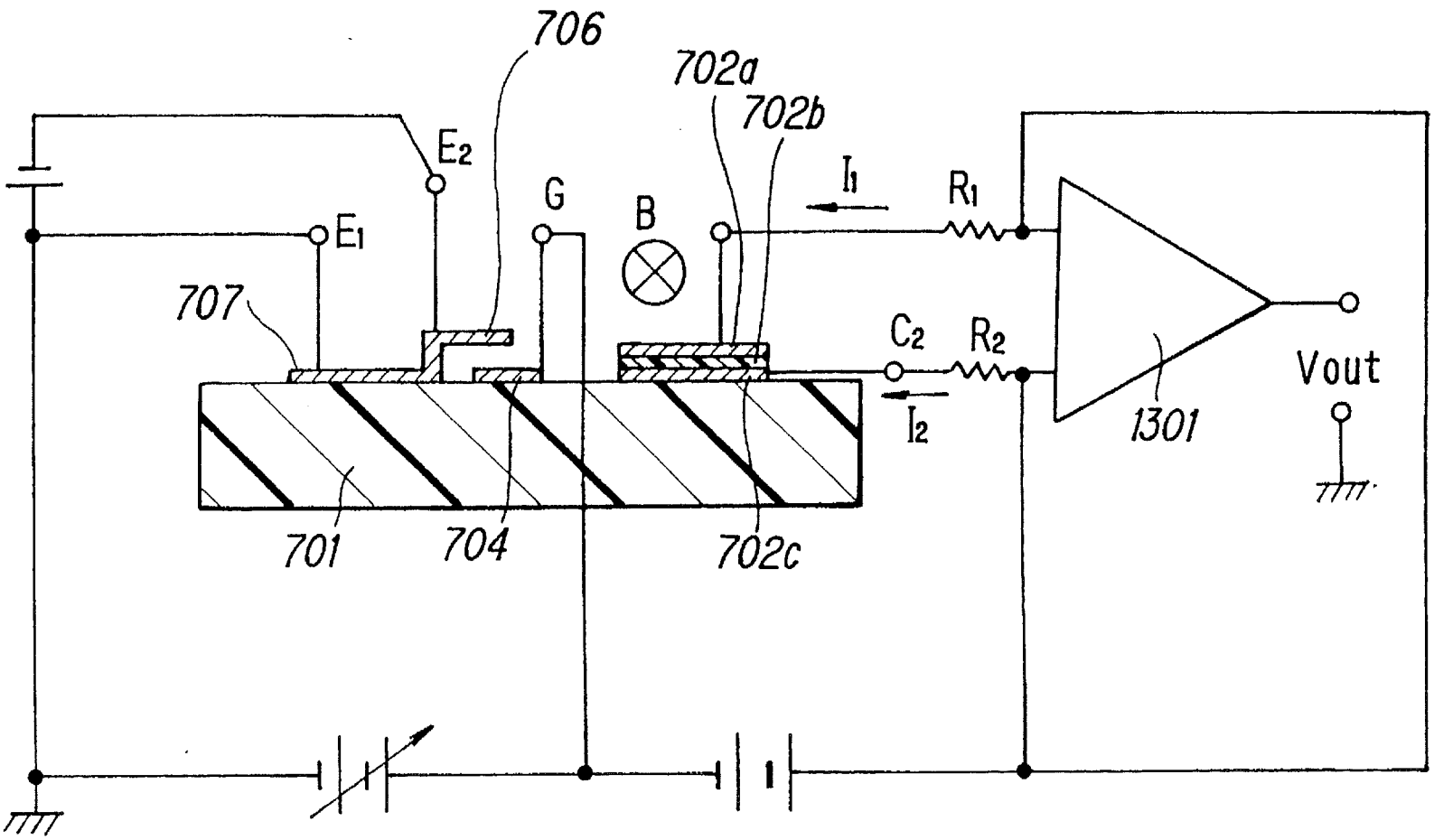
FIG. 9 is a circuit diagram illustrating a case where the micro vacuum device shown in FIG. 7 is applied in a magnetism sensor.

FIG. 9 is a circuit view illustrating a case where the micro vacuum device as shown in FIGS. 7, 8A and 8B is applied in a magnetism sensor, and in these figures a strength of the electrical currents $I_1$ and $I_2$ flowing in the two collectors 702*a* and 702*c* is differentially amplified by a differential amplifier 1301. A direction of a magnetic field B can be detected by checking which of the two currents $I_1$ and $I_2$ is larger, and further more a strength of the magnetic field B can be detected from a difference between the currents $I_1$ and $I_2$.

Also in the thin film heater/electron emitter 706 according to this embodiment, the sharp tip sections 710*a* and 710*b* are formed in a portion thereof. With this configuration, an electron beam flows more in the tip sections 710*a* and 710*b* as compared to that in a thin film heater/electron emitter having only one (1) piece of tip section. Also as shown in FIG. 8B, a silicon nitride film or a silicon oxide film under the tip sections 710*a* and 710*b* to support the bridge is removed, so that the heat capacity is reduced and a high temperature is obtained, which in turn contributes to reduction of power consumption.

Figure 10A:
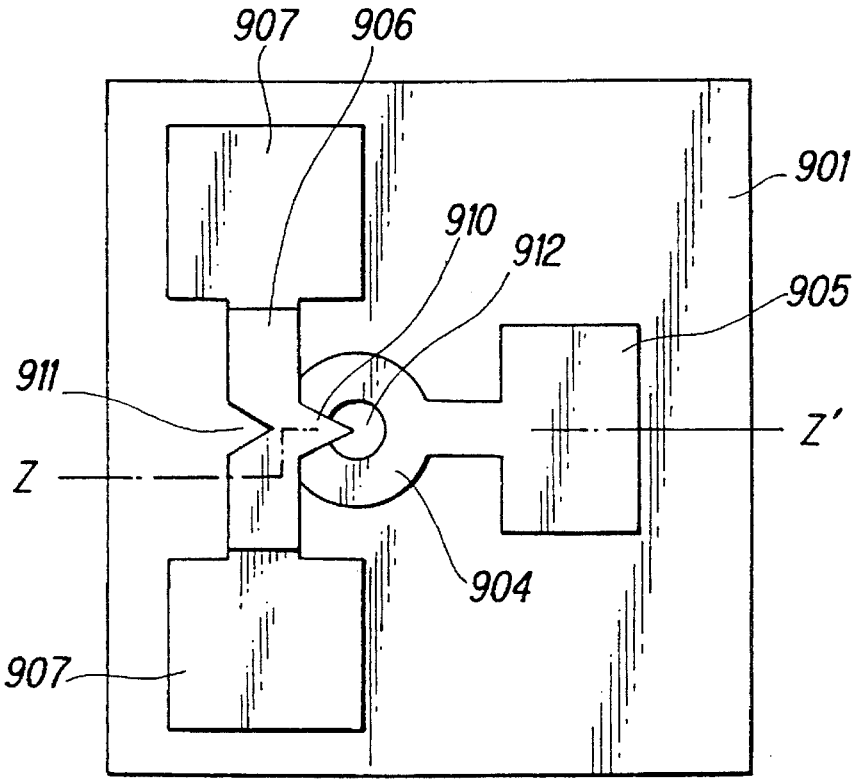
FIG. 10A is a flat view illustrating other configuration of the micro vacuum device according to the present invention.
Figure 10B:
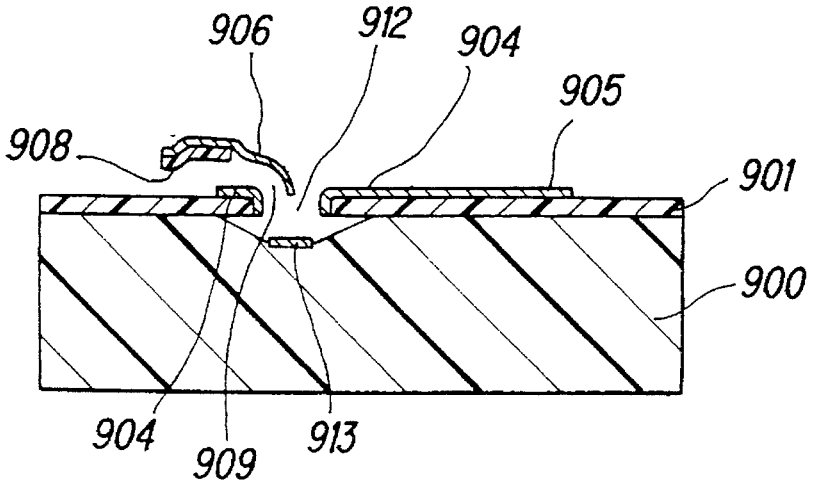
FIG. 10B is a cross sectional view illustrating the other configuration of the micro vacuum device according to the present invention above.

FIG. 10A and FIG. 10B are perspective views each illustrating another embodiment of the micro vacuum device according to the present invention, FIG. 10A is a flat view of the micro vacuum device, FIG. 10A is a flat view of the micro vacuum device, and FIG. 10B is a cross sectional view of the micro vacuum device shown in FIG. 10A taken along the line Z–Z' in the figure.

In FIG. 10A and FIG. 10B, designated at the reference numeral 900 is an N-shaped silicon substrate, at 901 a silicon oxide film formed on a surface of the N-shaped silicon substrate 900, at 904 a ring-shaped gate, at 905 a gate electrode which is an electrode of the gate 904, at 906 a thin film heater/electron emitter, at 907 an thin film heater/electron emitter electrode which is an electrode of the thin film heater/electron emitter 906, at 908 a silicon nitride thin film provided between the thin film heater/electron emitter 906 as well as the thin film heater/electron emitter electrode 907 and the silicon oxide film 901, at 909 a space formed between the gate 904 and the thin film heater/electron emitter 906, at 910 a sharpened tip section formed in a portion of the thin film heater/electron emitter 106, at 911 a slit provided in the base potion of said tip section 910, at 912 a hole penetrating through the gate 904, the silicon oxide film 901 and the N-shaped silicon substrate 900, and at 913 a platinum silicide as a collector provided in the hole 912. It should be noted that a diameter of the hole 912 should preferably be relatively small for better concentration of an electric field, and the diameter is preferably around 2 μm.

Next description is made to operations of the micro vacuum device according to this embodiment. This embodiment is an example of micro vacuum device in which the N-shaped silicon substrate is used as a collector electrode, and in this device, a quantity of electrons emitted from the thin film heater/electron emitter 906 can be changed by changing a voltage loaded to the thin film heater/electron emitter 906, so that this device can work as a triode vacuum tube. Herein, the gate 904 works as an electrode causing the thin film heater/electron emitter 906 to emit electrons.

Features of this embodiment consist in firstly that an electron emitter is formed as a heater, secondly that metallic silicide having a low electrical resistance (In this embodiment: platinum silicide) is used in the collector, and thirdly that, when a gate electrode is formed, a collector electrode made of platinum silicide below it can be formed through self alignment. This is because, when platinum for the gate electrode 905 is deposited by irradiating an electron beam thereto, the silicon oxide film 901 around the hole 912 is in an overhanging state and continuity between the gate electrode and the collector 913 made of platinum silicide below the gate electrode (inside the hole 912) is not established.

Figure 11:
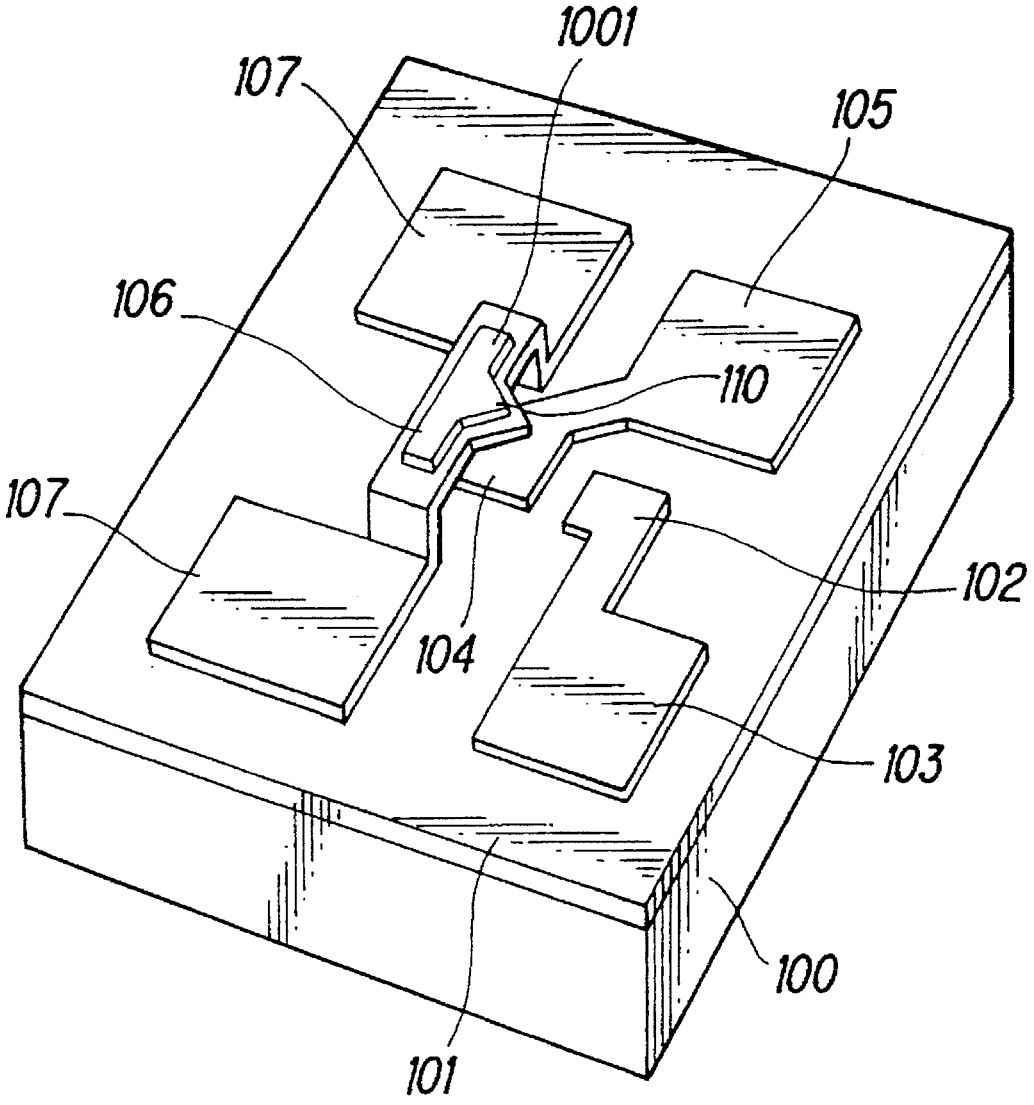
FIG. 11 is a perspective view illustrating different configuration of the micro vacuum device according to the present invention.
Figure 12A:
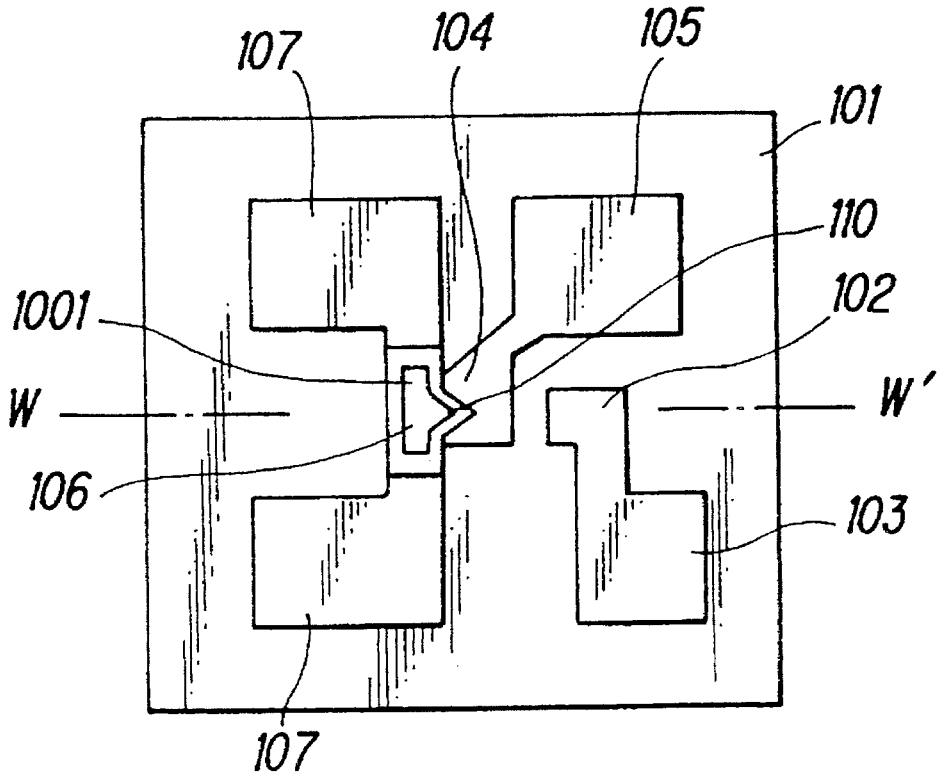
FIG. 12A is a flat view of the micro vacuum device shown in FIG. 11.
Figure 12B:
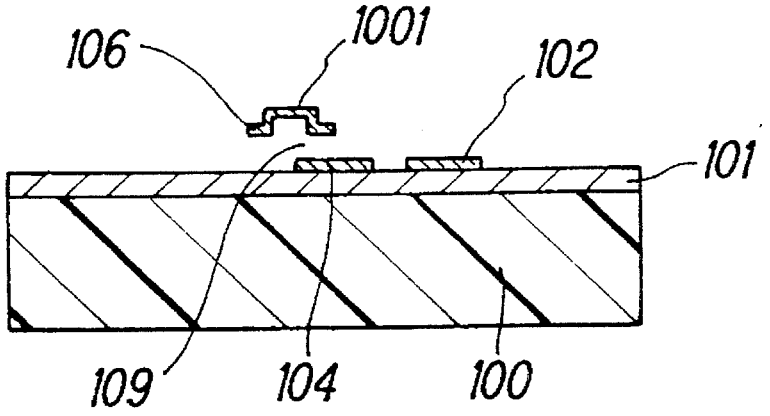
FIG. 12B is a cross sectional view of the micro vacuum device shown in FIG. 11.

FIG. 11 is a perspective view illustrating other embodiment of the micro vacuum device according to the present invention, FIG. 12A is a flat view of the micro vacuum device shown in FIG. 11, and FIG. 12B is a flat view of the micro vacuum device shown in FIG. 12A taken along the line W—W' in the figure. The same reference numerals are assigned to the same sections shown in FIG. 1, FIG. 2A and FIG. 2B, so that description concerning the sections is omitted herein.

In the embodiment described above, in order to increase a mechanical strength of the thin film heater/electron emitter 106 made of a bridged metallic dual layer (a molybdenum/titanium dual layer in this embodiment), the silicon oxide film 108 formed by means of sputtering is formed beneath it, but when used as a thermoelectron field emission type, it is necessary to raise the temperature to 1000° C. or more, so that a high melting point insulating thin film layer such as an aluminum oxide film may be used in place of the silicon oxide film 108 formed by means of sputtering, or it is advised to form the thin film heater/electron emitter 106 made of metal (molybdenum/titanium) without using the insulating films from the initial stage and form corrugation such as that of corrugated galvanized sheet iron in the bridged section for providing an effective thickness.

More detailed description is made for operations thereof with reference to FIG. 11, FIG. 12A and FIG. 12B. In the figures, the reference numeral 1001 indicates a convex section provided in the thin film heater/electron emitter 106. By providing a convex section as described above in the thin film heater/electron emitter 106, it is possible to suppress generation of distortion. For this reason, it is possible to maintain a space (around 0.5 μm) between the gate 104 and the thin film heater/electron emitter 106 and also to reduce a thickness of and power consumption in the thin film heater/electron emitter 106.

Figure 13:
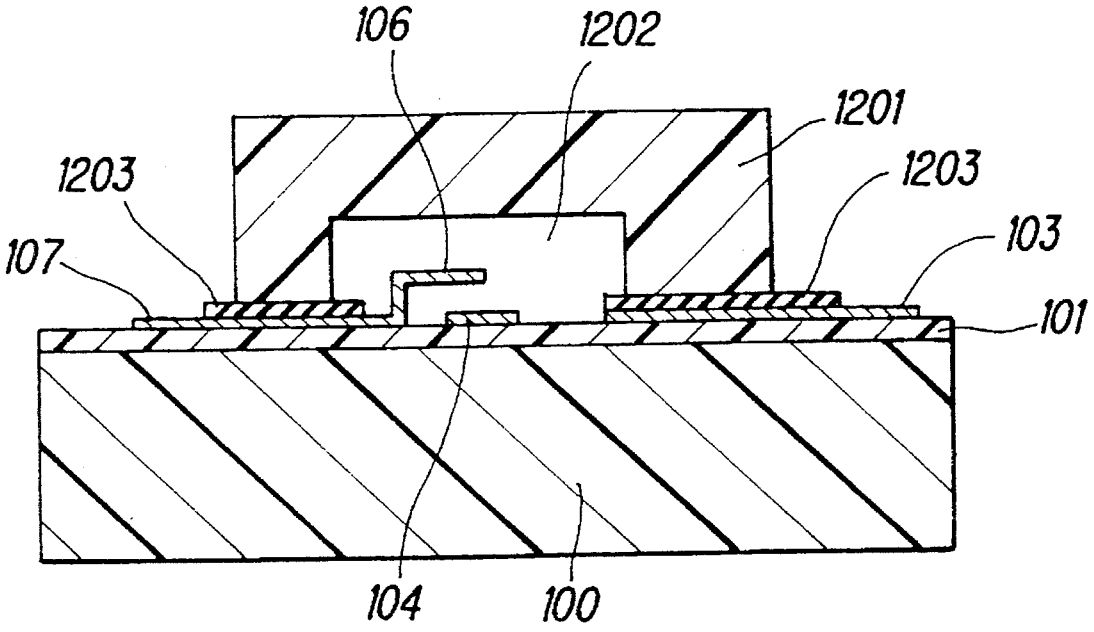
FIG. 13 is a view illustrating a state in which the micro vacuum device shown in FIG. 1 is sealed in a vacuum.

Next description is made for a method of forming a vacuum chamber in the micro vacuum device shown in FIG. 1, FIG. 2A and FIG. 2B with reference to FIG. 13. A micro device having the thin film heater/electron emitter 106, gate 104 and collector 102 formed as described above is sealed in a vacuum having a degree of vacuum of $10^{-6}$ Torr to form a micro vacuum device. By heating the thin film heater/electron emitter 106 to about 300° C. by flowing an electric current therein, loading a voltage of approximately 50 V to the thin film heater/electron emitter 106 so that a voltage in the collector 104 is positive, and furthermore loading a voltage to the gate 104 so that a voltage in the collector 102 is approximately positive 20 V, an electric current of about 1 μA flows stably, and it is possible to make it work as an electron emitter in a stable state.

In order to form a micro vacuum chamber, for instance a concave section 1202 is formed in a silicon chip 1201 by means of etching, and the concave section is sealed in a vacuum (around $10^{-6}$ Torr) by covering the section with a cap. Although there is slight corrugation such as an electrode, the section to be sealed is covered with an electrically insulating film (for instance, a silicon oxide film or a silicon nitride film) 1203 having a thickness of 1 μm by using such a method as CVD(chemical vapor diposition), then a low melting point metal (such as tin or lead) is deposited in a vacuum after nickel sputtering on a nickel film to a thickness enough to eliminate the corrugation, metal is deposited in a vacuum also on a junction surface of the cap side (the surface surrounding the sealed section), and a temperature is raised in a vacuum for sealing.

As described above, in each embodiment described above, of the electron emitter, gate and collector provided in a vacuum, the electron emitter is formed into a thin film form on a bridged thin film heater or as a thin film heater itself, while the gate is provided adjacent to the electron emitter with a space therebetween, so that the micro vacuum device can easily be formed by using the semiconductor micro machining technology.

Also, as the electron emitter is formed as a bridged thin film heater, a heat capacity as well as a heat conductance of the thin film heater can be reduced, and a large temperature rise can be obtained with small power consumption.

It should be noted that the thin film heater may be heated by, for instance, irradiating light from the outside or by Joule heating by flowing an electric current therein. Whether the thin film heater is of a field emission type or of a thermoelectron field emission type, the smaller a work function of the electron emitter, the more the electron emitter emits electrons, so that such an oxide as barium oxide or thorium oxide having a small work function is deposited on a thin film heater to form a thin film thereon to use it as an electron emitter. A tip section in the collector side of the electron emitter formed in the bridged thin film heater should preferably be a thin film yet having a shape for better concentration of an electric field and a higher electron emission efficiency.

In addition, a gate should preferably be formed only in a section adjacent to the sharp tip section of the bridged electron emitter with a space of 1 μm from a view point of voltage resistance of the electron emitter and the gate.

It should be noted that a thin film heater/election emitter of cantilever-type may be used.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A micro vacuum device having an electron emitter, a gate, and a collector each provided in a vacuum, wherein said electron emitter is formed into a thin film form on a thin film heater rising in midair and said electron emitter is a provided over a portion of said gate with a space therebetween so that said electron emitter causes field emission of electrons.

2. A micro vacuum device according to claim 1, wherein said thin film heater is formed as said electron emitter.

3. A micro vacuum device according to claim 1, wherein an electric current flowing between said electron emitter and said collector is changed by changing a voltage loaded to said gate.

4. A micro vacuum device according to claim 1, wherein a tip section of said electron emitter provided adjacent to said gate is sharpened.

5. A micro vacuum device according to claim 1, wherein said electron emitter provided adjacent to said gate has a plurality of tip sections each facing the same thin film heater.

6. A micro vacuum device according to claim 1, wherein a slit is provided on said electron emitter.

7. A micro vacuum device according to claim 1, wherein a plurality of said collectors are provided adjacent to each other, and a strength as well as a direction of an external magnetic field is detected from a strength of an electric current flowing in said plurality of collectors.

8. A micro vacuum device according to claim 7, wherein said collector is formed into a thin film form.

9. A micro vacuum device according to claim 8, wherein said collector comprises a plurality of layers with an insulating thin film sandwiched therebetween.

10. A micro vacuum device according to claim 1, wherein a convex section is provided on a surface of said electron emitter.

11. A micro vacuum device according to claim 1, wherein, using a silicon single crystal chip with a concave section formed on the surface, a region including said concave section is sealed in a vacuum to form a micro vacuum region and electrodes of said electron emitter, gate and collector are extended via an insulating thin film to outside of said vacuum region.

12. A micro vacuum device having an electron emitter, a gate and a collector each provided in a vacuum, wherein said collector is formed from a conductive substrate, a gate electrode is provided via an insulating thin film on said collector, a hole is formed in said insulating thin film so that said collector is exposed to inside of said gate electrode, an electron emitter formed into a thin film form on a thin film heater is provided near a center of said hole, and said electron emitter is provided over a portion of said gate so that said electron emitter causes field emission of electrons.

13. A micro vacuum device according to claim 12, wherein said thin film heater is formed as said electron emitter.

14. A micro vacuum device according to claim 12, wherein an electric current flowing between said electron emitter and said collector is changed by changing a voltage loaded to said gate.

15. A micro vacuum device according to claim 12, wherein a tip section of said electron emitter provided adjacent to a center of said hole is sharpened.

16. A micro vacuum device according to claim 12, wherein the electron emitter provided adjacent to a center of said hole has a plurality of thin film heaters.

17. A micro vacuum device according to claim 12, wherein a slit is provided on said electron emitter.

18. A micro vacuum device according to claim 12, wherein a convex section is provided on a surface of said electron emitter.

19. A micro vacuum device according to claim 12, wherein, using a silicon single crystal chip with a concave section formed on the surface, a region including said concave section is sealed in a vacuum to form a micro vacuum, region, and electrodes of said electron emitter, gate and collector are extended via an insulating thin film to outside of said micro vacuum region.

20. A micro vacuum device formed on a silicon substrate having a main surface, comprising:

an insulating film formed on said main surface of said silicon substrate;

a gate formed on said insulating film;

a collector formed on said insulating film spaced apart from said gate; and an electron emitter mounted on a thin film heater formed over and spaced apart from a portion of said gate.

21. The micro vacuum device according to claim 20, wherein the thin film heater and electron emitter are monolithically integrated.

22. The micro vacuum device according to claim 20, wherein an electric current flowing between said electron emitter mounted on a thin film heater and said collector is changed by changing a voltage loaded to said gate.

23. The micro vacuum device according to claim 20, wherein said electron emitter mounted on a thin film heater includes a sharpened tip section facing said collector.

24. The micro vacuum device according to claim 20, wherein said electron emitter mounted on a thin film heater includes a plurality of tip section facing the collector.

25. The micro vacuum device according to claim 20, wherein an upper surface of said electron emitter mounted on a thin film heater includes a slit.

26. The micro vacuum device according to claim 20, wherein said collector includes at least a first collector over a second collector with an insulating film therebetween, and a strength and direction of an external magnetic field is detected from a strength of an electric current flowing in said first and second collectors.

27. The micro vacuum device according to claim 26, wherein said collector is a thin film collector.

28. The micro vacuum device according to claim 27, wherein said collector consists of a first collector over a second collector with an insulting thin film therebetween.

29. The micro vacuum device according to claim 20, wherein an upper surface of said electron emitter mounted on a thin film heater has a convex section.

30. The micro vacuum device according to claim 20, further comprising a silicon single crystal chip having a concave area formed on a surface thereof, said silicon single crystal chip positioned on the micro vacuum device, sealing said gate, collector and electron emitter mounted on a thin film heater in a vacuum formed in said concave area, wherein said electron emitter mounted on a thin film heater, gate and collector each have a electrode, and the electrodes extend outside of said vacuum formed in said concave area via an insulating thin film.

31. A micro vacuum device formed on a silicon substrate having a main surface with a recess therein, comprising:

an insulating film formed on said main surface of said silicon substrate with an opening exposing at least a portion of said recess;

a ring-shaped gate and gate electrode formed on said insulating film with said ring-shaped gate having a circular opening over said recess;

a collector formed in the recess in said substrate proximate the center of said circular opening and exposed therethrough; and a electron emitter mounted on a thin film heater positioned over said ring-shaped gate and having a sharpened tip positioned proximate the center of said circular opening facing said collector so as to cause field emission of electrons upon application of a voltage.

32. The micro vacuum device according to claim 31, wherein the thin film heater and electron emitter are monolithically integrated.

33. The micro vacuum device according to claim 31, wherein an electric current flowing between said electron emitter mounted on a thin film heater and said collector is changed by changing a voltage loaded to said gate.

34. The micro vacuum device according to claim 31, wherein said electron emitter mounted on a thin film heater includes at least two stacked conductive layers.

35. The micro vacuum device according to claim 32, wherein an upper surface of said electron emitter mounted on a thin film heater includes a slit.

36. The micro vacuum device according to claim 31, wherein an upper surface of said electron emitter mounted on a thin film heater has a convex section.

37. The micro vacuum device according to claim 31, further comprising a silicon single crystal chip having a concave area formed on a surface thereof, said silicon single crystal chip positioned on the micro vacuum device, sealing said gate, collector and electron emitter mounted on a thin film heater in a vacuum formed in said concave area, wherein said electron emitter mounted on a thin film heater, gate and collector each have a electrode, and the electrodes extend outside of said vacuum formed in said concave area via an insulating thin film.

* * * * *